United States Patent [19]

Bateman, III

[11] 4,254,958

[45] Mar. 10, 1981

[54] ARROWHEAD AND METHOD OF MAKING

[76] Inventor: Earle W. Bateman, III, 705 Robin Cir., Pasadena, Tex. 77502

[21] Appl. No.: 88,874

[22] Filed: Oct. 29, 1979

[51] Int. Cl.[3] ..... F41B 5/02

[52] U.S. Cl. ..... 273/421; 29/1.2

[58] Field of Search ..... 273/419–422; 29/1.2, 23.5, 156.8 R, 156.8 B

[56] References Cited

U.S. PATENT DOCUMENTS

| | | | |
|---|---|---|---|
| 4,006,901 | 2/1977 | Simo | 273/422 |
| 4,175,749 | 11/1979 | Simo | 273/422 |

*Primary Examiner*—Paul E. Shapiro

*Attorney, Agent, or Firm*—Fulbright & Jaworski

[57] ABSTRACT

An arrowhead for attachment to an arrow shaft including a base for abutting the end of the shaft in which the base includes an opening in its center for receiving a fastener for securing the arrowhead to the shaft end. A plurality of support sides are connected to and extend generally perpendicular from the base and blades extend from the edges of the sides. The sides are generally rectangularly shaped and the blades are generally triangularly shaped. The method of making the arrowhead includes making a hole in a flat metal body having a variety of shapes, cutting a plurality of slits in the body extending from the outer edge of the body towards the center, bending the cut edges outwardly to form a blade at each cut edge, and bending the sides generally perpendicularly to the base for support.

12 Claims, 12 Drawing Figures

ARROWHEAD AND METHOD OF MAKING

BACKGROUND OF THE INVENTION

Conventional arrows used in hunting game, particularly small game, frequently pass through the game and while injuring the animal does not provide a stopping force. There is a need for a simple, inexpensive, but yet strong multi-bladed arrow point for use in hunting game. The present invention is directed to an arrowhead and method of making for attachment to an arrow shaft which will provide a sufficient shock force to stop the animal and thereby avoid losing a wounded animal.

SUMMARY

The present invention is directed to an arrowhead and method of making for attachment to an arrow shaft which includes a plurality of blades to increase the striking force of the arrow for insuring that the animal is stopped.

A further object of the present invention is the provisions of an arrowhead for attachment to a arrow shaft which includes a base for abutting the end of the shaft in which the base includes an opening for receiving a fastener for securing the base to the shaft. A plurality of support sides extend from the base and an outwardly extending blade is connected to each side. The support sides are connected to the base and extend generally perpendicular from the base for supporting the arrowhead from the shaft and providing support for the blades. Preferably a blade extends from each of the outer edges of the sides.

Yet a further object of the present invention is the provision of an arrowhead with a flat base having an opening in its center for attachment to the end of an arrow shaft and in which the blades are connected to the support sides at each outer edge of the support sides and extend outwardly from the sides and are in a plane generally perpendicular to the base. Preferably the support sides are generally rectangularly shaped and the blades are generally triangularly shaped.

Still a further object of the present invention is the provision of a point extending from the free end of each of the support sides and is directed towards the base for stopping penetration of the arrowhead.

Yet a still further object of the present invention is the provision of joining adjacent blades together to form a strengthened blade.

Yet a further object of the present invention is the provision of a method of making an arrowhead which utilizes various shaped metal bodies in which a hole is made in the center, and cutting a plurality of slits in the body extending from the outer edge of the body toward the center of the body to form a plurality of sides, bending the cut edges outwardly to form a blade at each cut edge, and folding the sides generally perpendicular to the plane of the cut hole for support.

Still a further object of the present invention is the provision of the method of making an arrowhead in which the slits are cut equal distance around the outer periphery of the body and extend toward but not to the hole in the center of the body.

Yet a still further object of the present invention is the method of making an arrowhead for attachment to an arrow shaft which includes making a hole in the center of a flat metal body, bending the outer edges of the body downwardly to form a base about the hole and generally perpendicularly extending support sides, and forming generally triangularly shaped blades at the outer edges of each side.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENTS

Figure 1:
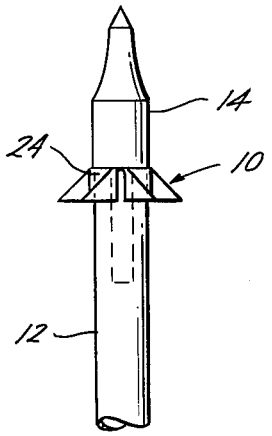
FIG. 1 is a fragmentary elevational view illustrating the preferred embodiment of the present invention connected to a conventional arrow.
Figure 2:
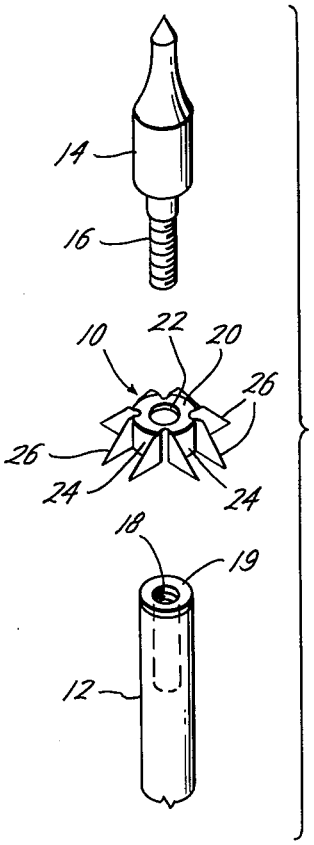
FIG. 2 is an exploded perspective view of the apparatus shown in FIG. 1.

Referring now to the drawings and particularly to FIGS. 1 and 2, the present invention is directed to providing an arrowhead generally indicated by the reference numeral 10 which is adapted to be secured to an arrow shaft 12 by any suitable fastening means 14 which may be a screw, a broadhead arrow point, or a conventional field point 14 as shown. The fastener 14 may be suitably connected to the end of the arrow shaft 12 such as by threads 16 which coact with a mating hole 18 to secure the arrowhead 10 on the end of the shaft 12 between the shaft 12 and the fastener 14.

The arrowhead 10 is a simple, inexpensive , but yet strong multi-bladed arrowhead for use in hunting game, particularly small game, which is adapted for ease of attachment to the arrow shaft 12. The arrowhead 10 includes a flat base 20 for abutting the end 19 of the shaft 12 and includes an opening 22 in its center for receivng the fastener 14 for securing the arrowhead 10 to the shaft 12. A plurality of support sides 24 are connected to the base 20 and extend generally perpendicular from the base 20 and are adapted to engage the outer periphery of the shaft 12 for additionally supporting the arrowhead 10 from the shaft 12. A plurality of blades 26 are provided which extend outwardly from and are supported by the support sides 24 and are in a plane generally perpendicular to the plane of the base 20. Preferably, each of the blades 26 is connected from an outer edge of each of the sides 24. Also preferably, the support sides 24 are generally rectangularly shaped and the blades 26 are generally triangularly shaped.

Figure 3:
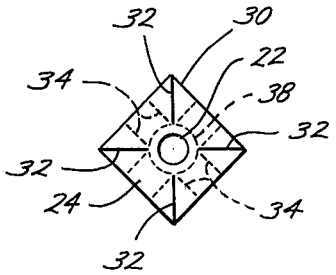
FIG. 3 is an elevational view illustrating the steps of making the arrowhead shown in FIGS. 1 and 2.
Figure 4:
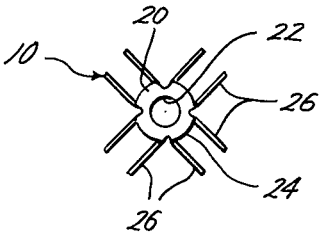
FIG. 4 is a top elevational view of the finished arrowhead of FIGS. 1–3.

Referring now to FIGS. 3 and 4, the method of making the arrowhead 10 is best seen. A flat metal body 30 is provided in which a hole 22 is made in the center such as by drilling. A plurality of slits is cut in the body such as slits 32 which are cut equal distance around the outer periphery of the body 30 toward but not extending to the hole 22. The body 30 is then bent along the dotted lines to form the finished arrowhead 10. Thus, the edges along each of the slits 32 are bent outwardly along the dotted lines 34 thereby forming the blades 26 which are triangularly shaped and which the leading edge is tapered downwardly and outwardly. The sides 24 are folded downwardly along a line 38 extending between the interior ends of the slits 32 to form the base 22 and the support sides 24. Thus, the preferred form of the present invention forms, as best seen in FIGS. 1–4, an eight-bladed arrowhead 10.

As shown in FIG. 4, the blades 26 are generally perpendicular to their connective support sides 24 thereby forming eight blades. If desired, the blades 26 may be bent upwardly from the support sides only 45 degrees whereby adjacent blades 26 will be positioned together to in effect form a four-bladed arrow in which the blades are of double thickness thereby strengthening the blades.

While the preferred embodiment of the present invention as illustrated in FIGS. 1–4, is directed to making an arrowead 10 from a flat square body 30, various other shapes such as triangles, circles, rectangles or hexagons may be utilized in a similar manner to provide a suitable arrowhead. Furthermore, any desired number of blades may be provided by suitably selecting the number of slits cut in the body. Other and further embodiments of the present invention will hereinafter be described wherein like parts will be like numbered to those shown in FIGS. 1–4, with the addition of the suffixes "a", "b", "c", and "d".

Figure 5:
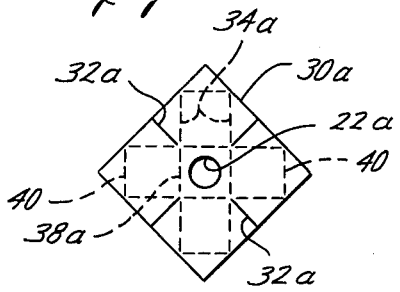
FIG. 5 is an elevational view illustrating the method of making another embodiment of the present invention.
Figure 6:
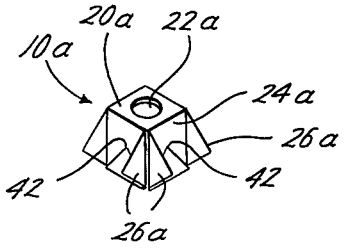
FIG. 6 is a perspective view of the finished arrowhead illustrated in FIG. 5.

Referring now to FIGS. 5 and 6, a body **30*a* is shown which is also a square in which a hole 22*a* is drilled in the center, but in which slits 32*a* are cut in the body 30*a* from the outer periphery of the square 30*a* from the midpoints of the sides of the square. Again, the cut areas along the slits 32*a* are bent outwardly along the dotted lines 34*a* to form a triangular shaped blade 26*a* on each outer side of each support side 24*a*. In addition, the bottom edge of each side 24*a* is folded along a dotted line 40 outwardly and upwardly to provide an upwardly directed point 42 which has the function of retarding penetration of the arrowhead 10*a* into an animal and thereby increasing its shock force. The sides 24*a* are bent downwardly along dotted lines 38*a* between the interior ends of the slits 32*a* to again form a base 22*a***.

Figure 7:
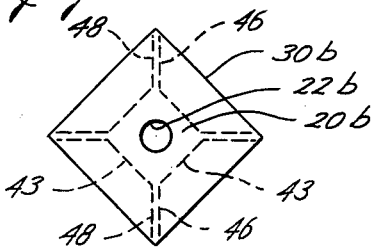
FIG. 7 is an elevational view illustrating the method of making a still further embodiment of the present invention.
Figure 8:
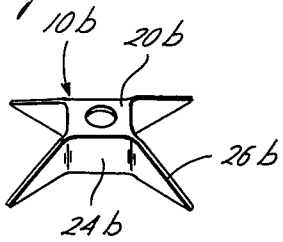
FIG. 8 is a perspective view of the finished arrowhead illustrated in FIG. 7.

Referring now to FIGS. 7 and 8, a still further embodiment of an arrowhead **10*b* is best seen in which the flat metal body 30*b* is a square in which a hole 22*a* is drilled in the center. However in this embodiment no slits are cut in the body 30*a*, but the body is folded along the dotted lines to provide an arrow 10*b* having a base 20*b*, the support sides 24*b* and four triangular shaped blades 26*b*. That is, the body 30*b* is bent or folded along lines 43 to provide the base 20*b* and sides 24*b*. In addition, the sides are bent or folded along adjacent lines 46 and 48 to form the blades 26*b*. If desired, the tapered leading edge of the blades 26*b*** may be sharpened for greater penetration if desired.

Figure 9:
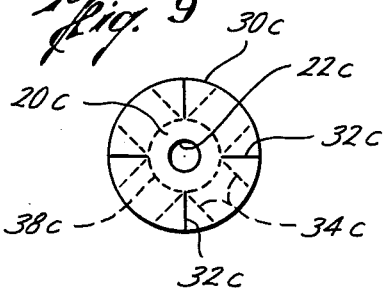
FIG. 9 is an elevational view illustrating the method of manufacture of another embodiment of the present invention.
Figure 10:
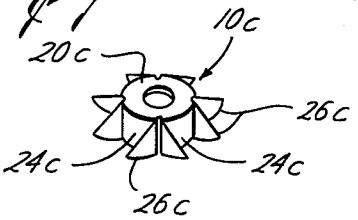
FIG. 10 is a perspective view of the finished arrowhead illustrated in FIG. 9.

Referring now to FIGS. 9 and 10, a flat metal body **30*c* is circularly shaped and again a hole 22*c* is drilled in the center for receiving a fastener 14 to attach the arrowhead 10*c* to a shaft 12. Again, a plurality of slits 32*c* are cut equidistancely around the outer periphery of the body 30*c* towards but not extending to the hole 22*c*. The cut edges along the slits 32*c* are bent outwardly along dotted lines 34*c* to form blades 26*c*. The sides formed between the slits 32*c* are bent downwardly along dotted lines 38*c* to form support sides 24*c* and base 20*c*. It is to be noted that the embodiments shown in FIG. 9 is provided with four cut slits 32*c* thereby forming eight blades 26*c***.

Figure 11:
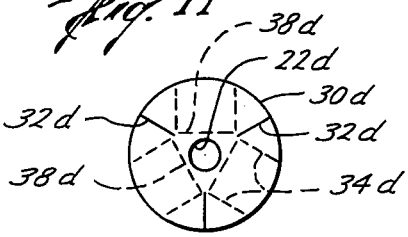
FIG. 11 is an elevational view of still a further embodiment of the present invention illustrating its method of manufacture.
Figure 12:
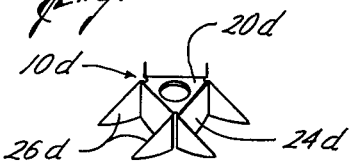
FIG. 12 is a perspective view of the finished arrowhead illustrated in FIG. 11.

Referring now to FIGS. 11 and 12, the method of making an arrowhead **10*d* is best seen in which the flat metal body 30*d* is again a circle in which a hole 22*d* is drilled in the center but in which only three slits 32*d* are cut equal distance around the outer periphery of the body 30*d*. Again, the cut edges are folded outwardly along dotted lines 34*d* to form blades 26*d* and the body is folded along lines 38*d* to form the base 20*d* and the sides 24*d*. In this embodiment, the use of three slits 32*d*** provides six blades.

As has been indicated, various shaped bodies may be used other than the square or circularly shaped bodies shown for purposes of illustration. For example, triangles, rectangles, or hexagons may be used. In addition, the number of blades desired may be obtained by suitably cutting the required number of slits. In addition, the leading edges of the blades may be sharpened if a greater cutting force is desired or the edges may be somewhat dull to provide a greater shock force.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will readily suggest themselves to those skilled in the art and which are encompassed within the spirit of the invention and the scope of the appended claims.

What is claimed is:

1. An arrowhead for attachment to an arrow shaft comprising, a base for abutting the end of the shaft, said base including an opening for receiving a fastener for securing the base to said shaft end, a plurality of support sides extending from said base, an outwardly extending blade connected to each side, said blades extend from the outer edges of said sides.

2. An arrowhead for attachment to an arrow shaft comprising, a base for abutting the end of the shaft, said base including an opening for receiving a fastener for securing the base to said shaft end, a plurality of support sides extending from said base, an outwardly extending blade connected to each side, and said adjacent blades are joined together to form a strenghtened blade.

3. An arrowhead for attachment to an arrow shaft comprising, a base abutting the end of the shaft, said base including an opening for receiving a fastener for securing the base of said shaft end, a plurality of support sides extending from said base,
an outwardly extending blade connected to each side, and
a point extends from the free edge of each side and is directed toward the base.

4. An arrowhead for attachment to an arrow shaft comprising,
a flat base for abutting the end of the shaft, said base including an opening in its center for receiving a fastener for securing the base to said shaft,
a plurality of support sides connected to said base and extending generally perpendicular to said base for enclosing the end of the shaft, and
a blade connected to each outer edge of said sides extending outwardly from said sides and in a plane generally perpendicular to said base.

5. The apparatus of claim 4 wherein the sides are generally rectangularly shaped and the blades are generally triangularly shaped.

6. The method of making an arrowhead for attachment to an arrow shaft comprising,
making a hole in a flat metal body,
cutting a plurality of slits in said body extending from the outer periphery of the body toward the center of the body to form a plurality of sides,
bending the cut edges outwardly to form a blade at each cut edge, and
folding the sides in a direction opposite to the direction of bending the cut edges to form a plurality of support sides generally perpendicular to the plane of the cut hole.

7. The method of claim 6 wherein the slits are cut equidistant around the outer periphery of the body.

8. The method of claim 7 wherein the body is a square, and the slits are cut from the corners of the square inwardly towards but not extending to the hole.

9. The method of claim 7 wherein the body is a square, and the slits are cut from a midpoint of each side and extend inwardly towards but not extending to the hole.

10. The method of claim 9 including,
bending the free ends of the sides upwardly to form upwardly directed points.

11. The method of claim 7 wherein the cut edges are bent to form triangularly shaped blades.

12. The method of making an arrowhead for attachment to an arrow shaft comprising,
making a hole in the center of a flat metal body,
bending the outer edges of the body downwardly to form a base about the hole and generally perpendicularly extending sides, and
forming generally triangularly shaped blades at the outer edges of each side.

* * * * *